US005251576A

United States Patent [19]

Nakagawa et al.

[11] Patent Number: 5,251,576

[45] Date of Patent: Oct. 12, 1993

[54] SYSTEM AND METHOD FOR FEEDING FUEL TO A FINE-PARTICLE-MIXED FUEL BURNING DIESEL ENGINE

[75] Inventors: Hiroshi Nakagawa; Yuuji Oda, both of Nagasaki, Japan

[73] Assignee: Mitsubishi Jukogyo Kabushiki Kaisha, Tokyo, Japan

[21] Appl. No.: 897,794

[22] Filed: Jun. 12, 1992

[30] Foreign Application Priority Data

Jun. 14, 1991 [JP] Japan ..... 3-143231
Jul. 23, 1991 [JP] Japan ..... 3-205630

[51] Int. Cl.[5] ..... F02D 19/04
[52] U.S. Cl. ..... 123/23
[58] Field of Search ..... 123/23, 304, 575

[56] References Cited

U.S. PATENT DOCUMENTS 4,662,315 5/1987 Sommer ..... 123/23
4,699,103 10/1987 Tsukahara et al. ..... 123/304

FOREIGN PATENT DOCUMENTS 0104368 4/1984 European Pat. Off. .
0282819 9/1988 European Pat. Off. .
0418601 3/1991 European Pat. Off. .
2924128 12/1980 Fed. Rep. of Germany .

OTHER PUBLICATIONS

Patent Abstracts of Japan, vol. 10, No. 163 (M-487) (2219), Jun. 11, 1986.

*Primary Examiner*—Noah P. Kamen
*Attorney, Agent, or Firm*—Wenderoth, Lind & Ponack

[57] ABSTRACT

In a system and method for feeding fuel, consisting of fine particles of solid fuel such as pulverized coal or the like and fuel oil, a predetermined amount of the fuel oil is fed into an oil reservoir within an injection valve through a control valve, and this fuel oil is injected through a nozzle hole of the injection valve with the aid of oil pressurized by a high-pressure pump. Only the above-mentioned fuel oil is injected, i.e. the pressurized oil is not injected. Also the aforementioned fuel oil never enters the high-pressure pump so as to prevent the plunger of the pump from seizing. The oil fed to the oil reservoir is returned to an oil tank via a circulation valve, and so, deterioration of the oil can be precluded. In addition, since the control valve is regulated by a signal indicating a position of a control rack which regulates the amount of oil delivered by the high-pressure pump, fuel oil in an amount corresponding to the amount of oil delivered by the high-pressure pump is sent to the aforementioned oil reservoir. Therefore, only the above-mentioned fuel oil will be reliably injected.

4 Claims, 2 Drawing Sheets

SYSTEM AND METHOD FOR FEEDING FUEL TO A FINE-PARTICLE-MIXED FUEL BURNING DIESEL ENGINE

BACKGROUND OF THE INVENTION

1. Field of the Invention

The present invention relates to a system and a method for feeding fuel to a diesel engine which make use of fuel oil containing fine particles of solid fuel such as pulverized coal or the like.

2. Description of the Prior Art

In a conventional diesel engine as shown in FIG. 2, fuel oil is fed from a fuel tank 101 through a fuel feed pump 102 to a fuel injection pump 103, then it is introduced into a fuel valve 108 as high-pressure fuel, and it is injected from a nozzle hole 109 into a combustion chamber of the engine. However, in the case of a diesel engine, when mixed fuel consisting of pulverized coal and water or fuel oil is pressurized to a high pressure and is injected to be burnt, a plunger would seize due to solid material of the mixed fuel within the plunger chamber and continued operations of the engine could not be effected.

It is to be noted that in FIG. 2, reference numeral 104 designates a plunger accommodated within a barrel 105 of the fuel injection pump 103, numeral 106 designates a delivery valve of the fuel injection pump 103, numeral 107 designates a fuel feed pipe, numeral 110 designates a needle valve of the fuel injection valve 108, numeral 111 designates an oil reservoir provided on the upstream side of the needle valve 110 within the fuel injection valve 108, and numeral 112 designates a spring for biasing the needle valve 110.

Inherently, in a high-pressure fuel injection pump, fuel having had its solid material filtered out is employed, and it is improper to directly feed mixed fuel consisting of solid material of pulverized coal and fuel oil to a fuel injection pump because the plunger will seize.

SUMMARY OF THE INVENTION

It is therefore one object of the present invention to provide a system and a method for feeding fuel to a fine-particle-mixed fuel burning diesel engine, which obviate the above-described shortcoming of the prior art of the seizure of a pump plunger, and which can achieve good operations even if mixed fuel consisting of fine particles of solid fuel and fuel oil is employed.

According to one aspect of the present invention, there is provided a fuel feed system of a fine-particle-mixed fuel burning diesel engine, in which fuel oil containing fine particles of solid fuel is employed as fuel to be burnt, and which comprises an injection valve (9) including a needle valve (11) for opening and closing a path between an oil reservoir (12) and a nozzle hole (10), a fuel feed pipe (15) interposed between the oil reservoir (12) of the injection valve and a fuel tank (19) for accommodating the fuel containing fine particles, a control valve (16) for controlling the amount of fuel flowing through the fuel feed pipe (15), a check valve (13) provided within the injection valve (9) to allow fuel flowing from the control valve (16) to flow only towards the oil reservoir (12), a high-pressure pump (3) for pressurizing oil within an oil tank (1) and feeding it to the injection valve (9), a pressure wave propagation pipe (8) connecting a delivery port of the high-pressure pump (3) and the oil reservoir (12) in the injection valve (9), a circulation valve (21) for opening and pipe (8), and a control device (20) for controlling the opening and closing of the circulation valve (21) and the control valve (16).

According to another aspect of the present invention, in the fuel feed system described above a control rack detector (23) detects a position of a control rack (24), which controls the amount of oil delivered by the high-pressure pump (3), and inputs a detection signal to the control device (20).

According to yet another aspect of the present invention, there is provided a method of fuel injection in a fine-particle-mixed fuel burning diesel engine, which method comprises the steps of feeding fuel containing fine particles of solid fuel from a fuel tank (19) to an oil reservoir (12) within an injection valve from the side of a needle valve seat of the injection valve through a check valve (13) by means of a pump (18), pressurizing the fuel within the oil reservoir with high-pressure oil which has been pressurized by a high-pressure pump (3) and which has passed through a pressure wave propagation pipe (8), and injecting the fuel through a nozzle hole (10) of the injection valve.

According to still another aspect of the present invention, the method of fuel injection also comprises the steps of inputting a signal issued from a control rack detector (23), provided to detect a position of a control rack (24) for controlling the amount of fuel delivered by the high-pressure pump (3), to a control device (20), controlling the amount of fuel containing fine particles actually delivered to the injection valve by the pump (18) based on the amount of oil delivered to the injection valve by the high-pressure pump (3), by controlling a control valve (16) by means of the control device (20), and sending the fuel containing particles of solid fuel into the oil reservoir (12) within the injection valve through the check valve (13).

According to the present invention provided with the above-described features, fuel in an amount controlled by the control valve, which is in turn controlled by the control device, is sent from the fuel tank through the fuel feed pipe to the oil reservoir in the fuel injection valve. On the other hand, the oil within the oil tank is pressurized by the high-pressure pump, and a pressurized wave of the oil is transmitted to the above-mentioned oil reservoir through the pressure wave propagation pipe, and the above-mentioned fuel containing fine particles which is present within the oil reservoir is injected through the nozzle hole of the injection valve. When this injection has ended, the oil sent to the injection valve through the circulation valve controlled by the control device is returned to the oil tank, and so, deterioration of the oil can be precluded. In this way, fuel containing fine particles is never fed to the high-pressure pump. Hence, the plunger of the same pump will not seize. Also, only the fuel containing fine particles is injected through the nozzle hole of the injection valve.

In addition, according to the present invention, owing to the fact that a detection signal issued from the control rack detector is input to the control device, and the amount of fuel containing fine particles to be fed to the oil reservoir is controlled by the control device on the basis of the amount of oil delivered by the high-pressure pump, only the same fuel containing fine particles is surely injected through the nozzle hole of the injection valve, and the oil propagating as the pressure wave can be prevented from being injected through the nozzle hole.

The above-mentioned and other objects, features and advantages of the present invention will become more apparent by referring to the following description of preferred embodiments of the invention taken in conjunction with the accompanying drawings.

DESCRIPTION OF THE PREFERRED EMBODIMENT

Figure 1:
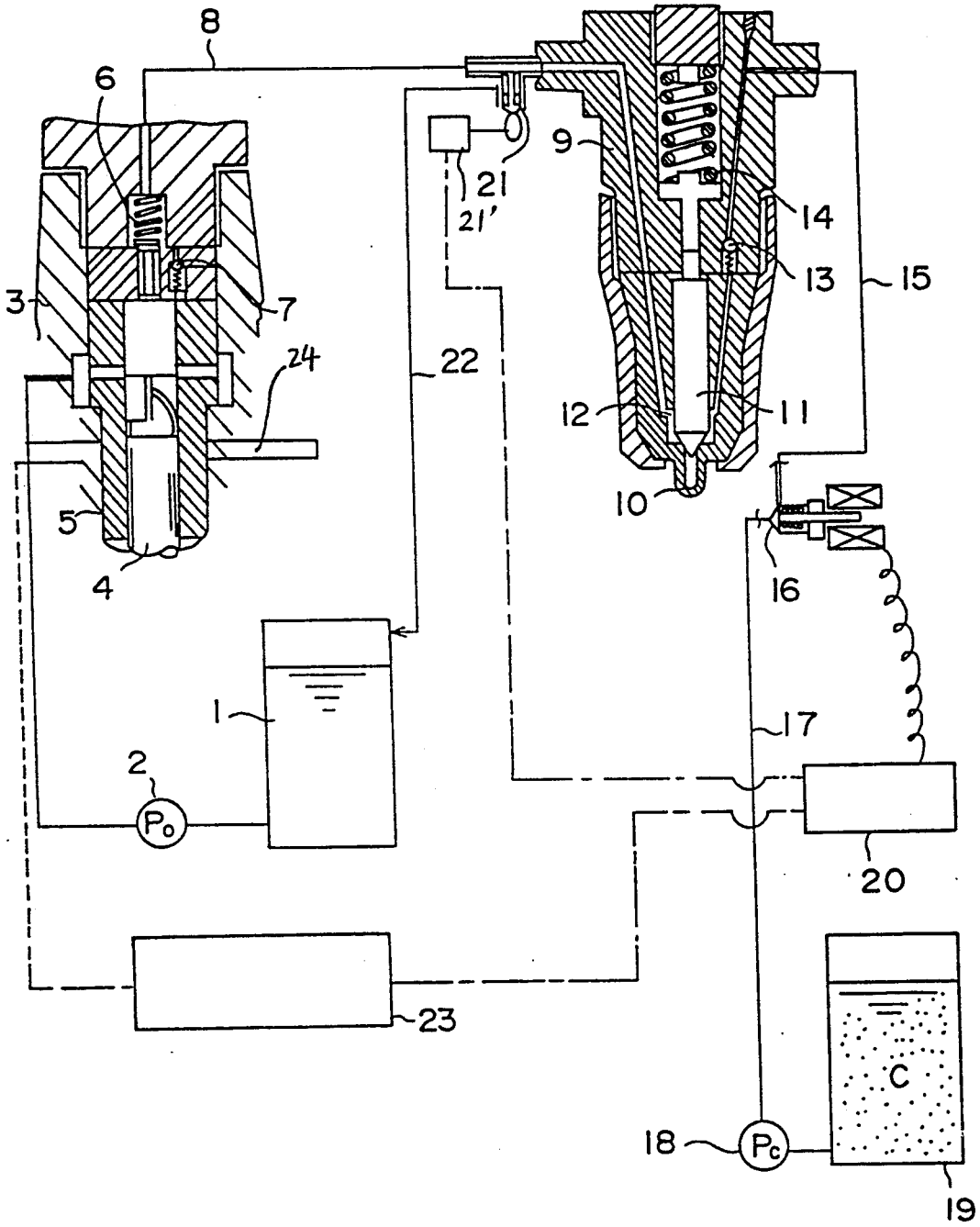
FIG. 1 is a schematic view of one preferred embodiment of the present invention.
Figure 2:
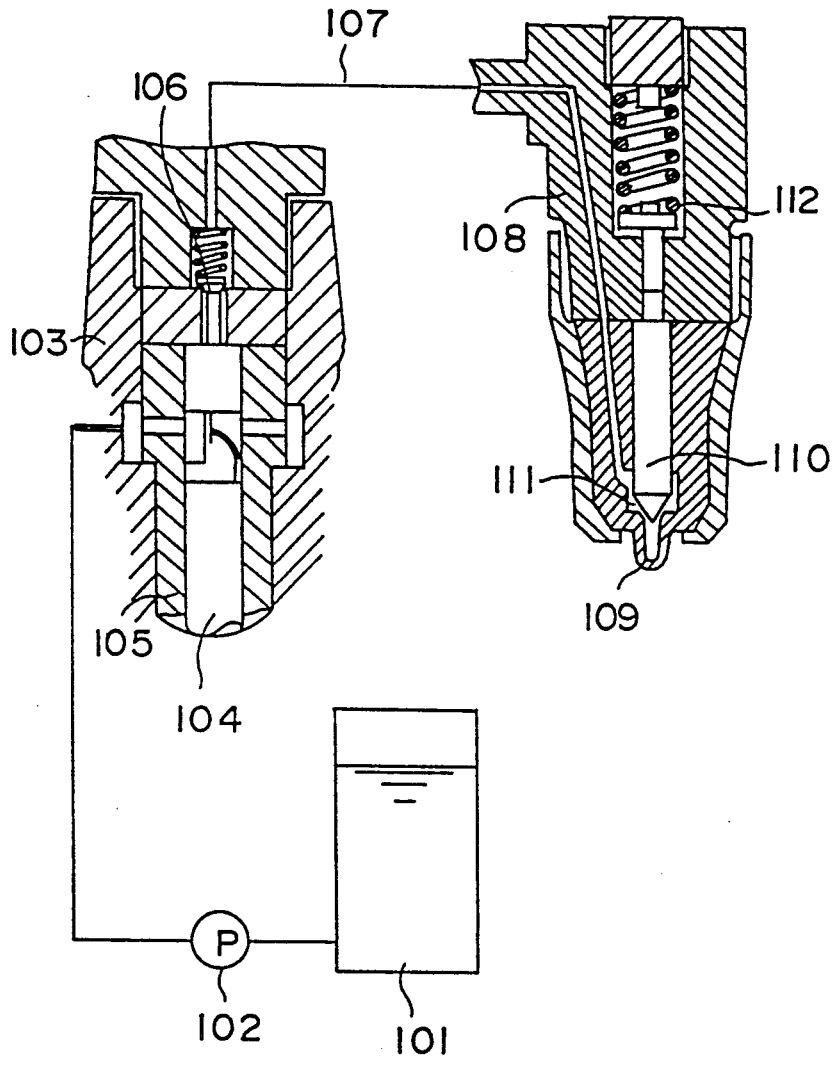
Fig. 2 (Prior Art)
FIG. 2 is a schematic view of one example of a fuel injection system for a diesel engine in the prior art.

Now one preferred embodiment of the present invention will be described with reference to FIG. 1. In this figure, reference numeral 1 designates an oil tank which accommodates oil for propagating as a pressure wave to a fuel valve, numeral 2 designates an oil feed pump, numeral 3 designates a high-pressure injection pump, numeral 4 designates a plunger, numeral 5 designates a barrel, numeral 6 designates a delivery valve, numeral 7 designates a pressure-regulating check valve, numeral 8 designates a pressure wave propagation pipe, numeral 9 designates a fuel injection valve, numeral 10 designates a numeral 11 designates a needle valve, numeral 12 designates an oil reservoir section, numeral 13 designates a check valve, numeral 14 designates a spring, numeral 15 designates a feed pipe, numeral 16 designates a control valve, numeral 17 designates a fuel feed pipe, numeral 18 designates a fuel feed pump, numeral 19 designates a fuel tank for accommodating fuel containing fine particles of coal, numeral 20 designates a control device, numeral 21 designates a circulation valve, numeral 21' designates a drive motor controlled by the control device 20, numeral 22 designates a circulation pipe, and numeral 23 designates a control rack detector for detecting a position of a control rack 24 which regulates the amount of oil delivered by the high-pressure injection pump.

Fuel containing fine particles of coal is fed by the fuel feed pump 18 from the fuel tank 19 through the fuel feed pipe 17 and enters the control valve 16, and during a pause in the fuel injection and after oil has been delivered through the pressure propagation pipe 8, a predetermined amount of fuel containing fine particles of coal is sent into the fuel injection valve 9 through the feed pipe 15. At this time, if the pressure at which the pressure-regulating check valve 7 of the high-pressure injection pump 3 opens is $P_R$, the pressure at which the check valve 13 opens is $P_P$, the pressure at which the needle valve 11 opens is $P_N$, and these values are preset so as to satisfy the relations of $P_N > P_P > P_R$, then the fuel fed rom the fuel tank 19 would pass through the check valve 13 and would flow into the oil reservoir section 12 in the fuel injection valve 9. Consequently, the oil which was present in this oil reservoir 12 is pushed back towards the high-pressure injection pump 3 through the pressure wave propagation pipe 8, and flows into the barrel (plunger chamber) 5 by forcibly opening the pressure-regulating check valve 7.

In addition, by detecting a position of the control rack 24 by means of the control rack detector 23 and inputting the detection signal to the control device 20 for controlling an opening/closing timing period of the control valve 16, an appropriate amount of fuel containing fine particles of coal is delivered into the oil reservoir section 12.

Under the above-mentioned condition, when the plunger 4 in the high-pressure fuel pump 3 rises to push up the delivery valve 6, the oil propagates as a pressure wave through the pressure wave propagation pipe 8 and to the fuel injection valve 9, and the pressure in the oil reservoir section 12 rises higher than the pressure $P_N$. Hence, the needle valve 11 opens against the biasing force of the spring 14, and injection through the nozzle hole 10 commences.

At this time, fuel in an amount corresponding to the position of the control rack of the high-pressure injection pump has been preliminarily fed into the oil reservoir section, and the oil having propagated as a pressure wave is not injected. Also, since the check valve 13 is closed, even if a high pressure is applied the fuel does not flow inversely towards the fuel tank.

After fuel injection, the circulation valve 21 is opened via the drive motor 21' as controlled by the control device 20, whereby the oil is circulated via the circulation pipe 22 to the oil tank 1, and so, deterioration of the oil can be prevented.

Owing to the above-mentioned structural features, fuel containing fine particles of solid fuel can be injected at a high pressure from an injection valve into a combustion chamber without introducing such fine-particle-mixed fuel into a barrel (plunger chamber) of a high-pressure pump.

Accordingly, the seizure of a high-pressure pump plunger caused by fine particles of solid fuel having a high hardness can be precluded. In addition, since the oil for propagating as a pressure wave from a high-pressure pump is also circulated, faults in hydraulic pressure due to deterioration of oil can also be eliminated.

While a principle of the present invention has been invention, it is intended that all matter contained in the above description and illustrated in the accompanying drawings shall be interpreted to be illustrative of and not as a limitation on the scope of the present invention.

What is claimed is:

1. A fuel feed system of a fine-particle-mixed fuel burning diesel engine in which fuel oil containing fine particles of solid fuel is employed as fuel to be burnt, said system comprising: an injection valve having an oil reservoir defined therein, a nozzle head defined therethrough and through which fuel is to be injected, and a needle valve movable between respective positions which open and close a path between the oil reservoir and the nozzle hole; a fuel feed pipe interposed between the oil reservoir of said injection valve and a fuel tank for accommodating fuel containing fine particles; a control valve operative to control the amount of fuel flowing through said fuel feed pipe; a check valve provided within said injection valve and which allows fuel flowing from the control valve to flow only towards the oil reservoir; a high-pressure pump operatively interposed between an oil tank and said injection valve so as to pressurize oil within the oil tank and feed it to the injection valve; a pressure wave propagation pipe interposed between a delivery port of said high-pressure pump and the oil reservoir defined in the injection valve; a circulation valve operative to open and close said pressure wave propagation pipe; and a control device which controls the opening and closing of said circulation valve and said control valve.

2. A fuel feed system of a fine-particle-mixed fuel burning diesel engine as claimed in claim 1, and further comprising a control rack which regulates the amount of oil delivered by said high-pressure pump through said delivery port thereof, and a control rack detector which detects a position of said control rack and inputs a detection signal to said control device.

3. A method of carrying out fuel injection in a fine-particle-mixed fuel burning diesel engine, said method comprising: pumping fuel containing fine particles of solid fuel from a fuel tank to an oil reservoir defined within a fuel injection valve via a check valve; pressurizing oil, and delivering the pressurized oil with a high-pressure pump to the oil reservoir defined within the fuel injection valve via a pressure wave propagation pipe so as to pressurize fuel within the oil reservoir; regulating the amount of oil delivered by the high-pressure pump to the oil reservoir with a control rack operatively associated with the high-pressure pump in a manner in which the position of the control rack establishes the amount of oil delivered by the high-pressure pump; detecting the position of the control rack and inputting a signal corresponding to said position to a control device; controlling a control valve with the control device so as to in turn control the amount of fuel containing fine particles of solid fuel which is pumped to the fuel injection valve, based on the amount of oil delivered to the fuel injection valve by the high-pressure pump; and injecting the fuel through a nozzle of the fuel injection valve.

4. A method of carrying out fuel injection in a fine-particle-mixed fuel burning diesel engine, said method comprising: pumping fuel containing fine particles of solid fuel from a fuel tank to an oil reservoir defined within a fuel injection valve via a check valve; pressurizing oil, and delivering the pressurized oil with a high-pressure pump to the oil reservoir defined within the fuel injection valve via a pressure wave propagation pipe so as to pressurize fuel within the oil reservoir; circulating the oil that has been delivered to the fuel injection valve back to the high-pressure pump by controlling a circulation valve operatively associated with the pressure wave propagation pipe; and injecting the fuel through a nozzle of the fuel injection valve.

* * * * *